US010590682B2

(12) United States Patent
Chevalier

(10) Patent No.: US 10,590,682 B2
(45) Date of Patent: Mar. 17, 2020

(54) CLOSURE AND LATCHING MECHANISMS

(71) Applicant: John Phillip Chevalier, London (GB)

(72) Inventor: John Phillip Chevalier, London (GB)

( * ) Notice: Subject to any disclaimer, the term of this patent is extended or adjusted under 35 U.S.C. 154(b) by 497 days.

(21) Appl. No.: 15/308,883

(22) PCT Filed: May 6, 2015

(86) PCT No.: PCT/GB2015/051330

§ 371 (c)(1),
(2) Date: Nov. 4, 2016

(87) PCT Pub. No.: WO2015/170097

PCT Pub. Date: Nov. 12, 2015

(65) Prior Publication Data

US 2017/0074007 A1 Mar. 16, 2017

(30) Foreign Application Priority Data

May 7, 2014 (GB) ..... 1408075.8

(51) Int. Cl.
*E05B 81/20* (2014.01)
*E05B 81/14* (2014.01)
(Continued)

(52) U.S. Cl.
CPC ..... *E05B 81/20* (2013.01); *E05B 81/14* (2013.01); *E05B 81/66* (2013.01); *E05B 81/90* (2013.01);
(Continued)

(58) Field of Classification Search
CPC ..... E05B 81/20; E05B 81/14; E05B 81/66; E05B 81/90; E05B 81/42; Y10T 292/108;
(Continued)

(56) References Cited

U.S. PATENT DOCUMENTS 4,395,064 A * 7/1983 Bellot ..... E05B 81/20 292/201
4,892,339 A * 1/1990 Kleefeldt ..... E05B 81/20 292/201
(Continued)

FOREIGN PATENT DOCUMENTS

DE 102010024295 12/2011
EP 0038226 10/1981
(Continued)

OTHER PUBLICATIONS

International Search Report dated Jul. 20, 2015 from corresponding PCT Application No. PCT/GB2015/051330, filed May 6, 2015.

*Primary Examiner* — Kristina R Fulton
*Assistant Examiner* — Faria F Ahmad
(74) *Attorney, Agent, or Firm* — Honigman LLP

(57) ABSTRACT

A closing and latching mechanism for a closure in which further rotation of an input shaft in a latching direction results in engagement of a release cam with a release cam follower and movement of a release slider which moves a pawl into a position in which a claw is free to move from a latched position to an unlatched position and the claw then moves towards the unlatched position under the action of a biasing spring.

22 Claims, 9 Drawing Sheets

(51) Int. Cl.

| | |
|---|---|
| ***E05B 81/66*** | (2014.01) |
| ***E05B 81/90*** | (2014.01) |
| ***E05B 81/42*** | (2014.01) |
| ***E05B 81/72*** | (2014.01) |
| ***E05B 81/68*** | (2014.01) |

(52) U.S. Cl.
CPC ..... *E05B 81/15* (2013.01); *E05B 81/42* (2013.01); *E05B 81/68* (2013.01); *E05B 81/72* (2013.01); *Y10S 292/23* (2013.01); *Y10T 292/108* (2015.04); *Y10T 292/1046* (2015.04); *Y10T 292/1047* (2015.04); *Y10T 292/1048* (2015.04); *Y10T 292/1062* (2015.04); *Y10T 292/1075* (2015.04); *Y10T 292/1077* (2015.04); *Y10T 292/1082* (2015.04); *Y10T 292/1092* (2015.04)

(58) Field of Classification Search
CPC ..... Y10T 292/1082; Y10T 292/1047; Y10T 292/1092; Y10T 292/1048; Y10T 292/1046; Y10T 292/1077; Y10T 292/1075; Y10T 292/1062; Y10S 292/23
USPC ..... 292/DIG. 23
See application file for complete search history.

(56) References Cited

U.S. PATENT DOCUMENTS 4,906,035 A * 3/1990 Nagai ..... E05B 81/20 292/201
4,974,885 A * 12/1990 Yokoyama ..... E05B 81/20 292/201
5,074,603 A * 12/1991 Brackmann ..... E05B 81/14 292/201
5,918,917 A * 7/1999 Elton ..... E05B 81/20 292/201
5,921,595 A * 7/1999 Brackmann ..... E05B 83/36 292/201
6,076,868 A * 6/2000 Roger, Jr. ..... E05B 81/14 292/199
6,367,296 B1 * 4/2002 Dupont ..... E05B 81/16 292/201
6,428,058 B1 * 8/2002 Graute ..... E05B 85/01 292/201
6,439,623 B1 * 8/2002 Lohfeld ..... E05B 81/20 292/201
6,471,259 B1 * 10/2002 Weyerstall ..... E05B 81/14 292/201
6,511,106 B2 * 1/2003 Perkins ..... E05B 81/16 292/216
6,517,128 B2 * 2/2003 Perkins ..... E05B 81/14 292/201
6,540,272 B2 * 4/2003 Spurr ..... E05B 85/243 292/216
6,773,042 B2 * 8/2004 Spurr ..... E05B 77/02 292/201
6,932,393 B2 * 8/2005 Erices ..... E05B 81/06 292/216
7,080,861 B2 * 7/2006 Watanabe ..... E05B 83/36 292/216
7,175,210 B2 * 2/2007 Orzech ..... E05B 81/14 292/201
7,175,212 B2 * 2/2007 Cetnar ..... E05B 81/20 292/201
7,210,714 B2 * 5/2007 Berghahn ..... E05B 81/20 292/201
7,261,338 B2 * 8/2007 Spurr ..... E05B 81/20 292/201
7,416,229 B2 * 8/2008 Stefanic ..... E05B 81/14 292/201
7,467,815 B2 * 12/2008 Larsen ..... E05B 81/14 292/201
7,568,740 B2 * 8/2009 Brose ..... E05B 81/06 292/201
7,770,946 B2 * 8/2010 Kouzuma ..... E05B 81/20 292/201
8,186,730 B2 * 5/2012 Berghahn ..... E05B 81/14 292/201
8,448,999 B2 * 5/2013 Grifoll Sauri ..... E05B 81/14 292/201
8,955,889 B2 * 2/2015 Bendel ..... E05B 81/20 292/200
9,273,497 B2 * 3/2016 Torka ..... E05B 77/36
9,677,305 B2 * 6/2017 Bendel ..... E05B 81/05
2001/0024040 A1 * 9/2001 Spurr ..... E05B 85/243 292/216
2002/0050721 A1 * 5/2002 Kobayashi ..... E05B 85/01 292/216
2002/0105192 A1 * 8/2002 Perkins ..... E05B 81/14 292/216
2002/0157435 A1 * 10/2002 Wicker ..... E05B 81/06 70/237
2003/0062727 A1 * 4/2003 Reddmann ..... E05B 81/14 292/197
2003/0116977 A1 * 6/2003 Erices ..... E05B 81/06 292/201
2003/0127866 A1 * 7/2003 Martinez ..... E05B 17/0029 292/216
2004/0094971 A1 * 5/2004 Warmke ..... E05B 81/06 292/201
2004/0113438 A1 * 6/2004 Kachouh ..... E05B 81/14 292/201
2004/0174021 A1 * 9/2004 Tensing ..... E05B 81/14 292/216
2004/0174022 A1 * 9/2004 Inoue ..... E05B 81/06 292/216
2004/0227359 A1 * 11/2004 Coleman ..... E05B 77/26 292/254
2005/0040658 A1 * 2/2005 Larsen ..... E05B 81/14 292/229
2005/0082842 A1 * 4/2005 Warmke ..... E05B 77/28 292/216
2005/0212302 A1 * 9/2005 Fisher ..... E05B 81/14 292/216
2005/0218661 A1 * 10/2005 Brose ..... E05B 81/06 292/216
2006/0006671 A1 * 1/2006 Noel ..... E05B 77/26 292/216
2006/0028029 A1 * 2/2006 Spurr ..... E05B 81/20 292/216
2006/0049642 A1 * 3/2006 Dupont ..... E05B 83/36 292/216
2006/0055180 A1 * 3/2006 Kachouh ..... E05B 77/36 292/216
2006/0055181 A1 * 3/2006 Berghahn ..... E05B 81/20 292/216
2006/0103145 A1 * 5/2006 Ottolini ..... E05B 81/14 292/216
2006/0208504 A1 * 9/2006 Kachouh ..... E05B 85/26 292/216
2006/0226661 A1 * 10/2006 Moore ..... E05B 81/20 292/216
2006/0284425 A1 * 12/2006 Torka ..... E05B 81/20 292/201
2007/0029814 A1 * 2/2007 Coleman ..... E05B 81/14 292/201
2008/0121062 A1 * 5/2008 Yoda ..... E05B 83/36 74/469
2008/0217928 A1 * 9/2008 Spurr ..... E05B 81/20 292/198
2008/0303291 A1 * 12/2008 Spurr ..... E05B 81/14 292/216
2009/0025999 A1 * 1/2009 Ishiguro ..... E05B 77/26 180/287
2009/0051173 A1 * 2/2009 Akizuki ..... E05B 77/26 292/216
2009/0218830 A1 * 9/2009 Yamagata ..... E05B 81/25 292/336.3

(56) References Cited

U.S. PATENT DOCUMENTS

2009/0241617 A1* 10/2009 Takahashi ..... E05B 81/16 70/257
2009/0243308 A1* 10/2009 Ishiguro ..... E05B 17/041 292/196
2009/0243309 A1* 10/2009 Takahashi ..... E05B 77/28 292/201
2009/0284025 A1* 11/2009 Salcombe ..... B64C 25/26 292/201
2009/0322104 A1* 12/2009 Nam ..... E05B 85/243 292/216
2010/0127511 A1* 5/2010 Vasquez ..... E05B 81/06 292/201
2010/0170308 A1* 7/2010 Wattebled ..... E05B 81/20 70/77
2010/0171320 A1* 7/2010 Cumbo ..... E05B 81/14 292/200
2010/0171321 A1* 7/2010 Akizuki ..... E05B 77/26 292/200
2010/0283268 A1* 11/2010 Cumbo ..... E05B 77/06 292/196
2010/0327609 A1* 12/2010 Akizuki ..... E05B 81/06 292/85
2011/0187129 A1* 8/2011 Graute ..... E05B 81/20 292/2
2011/0187132 A1* 8/2011 Scholz ..... E05B 81/20 292/226
2011/0204659 A1* 8/2011 Estrada ..... E05B 81/14 292/200
2011/0214460 A1* 9/2011 Byun ..... E05B 81/00 70/91
2012/0266639 A1* 10/2012 Yamagata ..... E05B 79/08 70/372
2014/0203572 A1* 7/2014 Barmscheidt ..... E05B 77/28 292/200
2015/0284977 A1* 10/2015 Barmscheidt ..... E05B 81/14 292/200
2018/0163439 A1* 6/2018 Patane ..... E05B 81/20

FOREIGN PATENT DOCUMENTS

EP 1746230 1/2007
WO WO2010067074 6/2010

* cited by examiner

CLOSURE AND LATCHING MECHANISMS

CROSS REFERENCE TO RELATED APPLICATIONS

The present application is a 371 national phase filing of PCT Application No. PCT/GB2015/051330, filed May 6, 2015, which claims the filing benefit of GB patent application No. 1408075.8, filed May 7, 2014, which are hereby incorporated herein by reference in their entireties.

The present invention relates to closure and latching mechanisms, particularly for doors and most particularly for motor vehicle doors. The invention is concerned with that type of such mechanism which is moved under power between the latched and unlatched or semi-latched positions. Specifically, the invention relates to closure and latching mechanisms of the type comprising a claw for engaging a striker fixed to a door or other closure, a pawl for latching open the claw and motor drive means for moving the pawl so that it releases the claw and for moving the claw into the latched position.

WO2010/067074 discloses an automotive closure and latching mechanism including a pivotally mounted claw, a pawl and an arcuate drive lever. The claw is retained in its fully latched position by the engagement of latching shoulders on the pawl and the claw and the striker is thus retained captive within the recess defined by the claw. When the tailgate or the like is to be opened, an electric motor is operated in one direction and the drive lever is rotated in one direction. A post on the drive lever contacts the pawl and rotates it so that the latching shoulders move out of engagement. The claw is now moved by a spring acting on it into the semi-latched position. When the latch is to be re-latched, the motor is operated in the opposite direction and a cam surface causes the drive lever to rotate in the other direction. This causes the post on the drive lever to contact the claw and rotate it into the latched position. Thus in this known mechanism there is a common lever which is used to enable both release and complete the closure. When driven in one direction, this lever acts directly on the pawl to release the claw and when driven in the opposite direction, it acts directly on the claw to drive it from an intermediate latched position to a fully latched position.

According to the present invention a closing and latching mechanism for a closure includes a claw for engaging a striker fixed to the closure, the claw being rotatable between an unlatched position and a latched position and biased by a spring towards the unlatched position, a pawl mounted to pivot between a first position, in which it can engage the claw in the latched position and prevent movement of the claw into the unlatched position, and a second position, in which the claw is free to move from the latched position to the unlatched position, a rotatable input shaft carrying a first clinch cam which is operatively coupled to the claw, whereby rotation of the input shaft in one direction results in rotation of the claw into the latched position, the input shaft also carrying a release cam which cooperates with a release cam follower forming part of a release slider, the release slider being operatively coupled to the pawl, whereby further rotation of the input shaft in the said one direction results in engagement of the release cam with the release cam follower and movement of the release slider which moves the pawl into the second position and the claw then moves towards the unlatched position under the action of the biasing spring.

Thus in the mechanism in accordance with the invention there is no common lever, as in the prior document and instead release of the mechanism is induced by a dedicated cam being driven in one direction acting on a release slider whilst latching of the mechanism is effected by a further dedicated cam carried by the same shaft and rotated in the same direction which acts on the claw to move it into the latched position.

In a preferred embodiment the first clinch cam is operatively coupled to the claw by a first clinch cam follower, which cooperates with the first clinch cam and is provided on a linearly movable clinch slider, the clinch slider being operatively coupled to a second clinch cam, which cooperates with a second clinch cam follower forming part of a pivotally mounted clinch lever, a further part of the clinch lever constituting a third clinch cam which cooperates with a third clinch cam follower constituted by a portion of the claw.

The operative connection between the first clinch cam and the claw preferably provides a mechanical advantage of at least 2, preferably at least 4. The operative connection is preferably constructed so that the mechanical advantage increases as the claw approaches the fully latched position. The clinch lever may be of generally T shape with the head of the T constituted by two limbs, a first of which constitutes the second clinch cam follower and the second of which is shorter than the first limb and constitutes the third clinch cam. The distance of the third clinch cam follower from the axis of rotation of the claw may be at least 2 and preferably 3 times greater than the distance between the said axis of rotation and the position at which, in use, the claw engages the striker. The combination of these features results in an overall mechanical advantage of at least 10 and potentially even as much as 20, e.g. 15, and this enables the electric motor to be considerably smaller, cheaper and lighter than is usual.

The mechanism preferably includes a manual release lever which is operably coupled to the pawl and the operation of which results in movement of the pawl into the second position.

The operative connection between the first clinch cam and the claw preferably includes a clutch or releasable connection which is selectively operable to sever or interrupt the operative connection. The clutch may comprise a clutch member connected to the clinch slider and movable between an engaged position in which movement of the clinch slider in the latching direction is transmitted to the claw and a disengaged position in which movement of the clinch slider is not transmitted to the claw.

The mechanism may include a release drive dog mounted to pivot about the same axis as the pawl and arranged to engage the pawl and to rotate it from the first position into the second position, the release drive dog being pivotally connected to the release slider and arranged to pivot about the said axis when the release slider is caused to move by the release cam. The manual release lever is preferably mounted to pivot about the same axis as the pawl and is arranged to engage the pawl and to rotate it from the first position into the second position when the manual release lever is operated.

In the preferred embodiment, the release slider carries a ratchet which affords the release cam follower, the ratchet being movable between a first position, in which the release cam can engage the release cam follower and move the release slider in the latching direction, and a second position in which the release cam may move past the release cam follower without contacting it, movement between the two positions being permitted when the release cam is not in contact with the release cam follower and being prevented when the release cam is in contact with the release cam follower, the mechanism carrying a third cam arranged to engage the ratchet and push it from the first position to the second position. Thus if the clinching or closing operation of the latch mechanism should be interrupted for some reason, e.g. as a result of an obstacle preventing the door from closing fully, the closing operation is terminated and the input shaft is rotated in the reverse direction and as it moves it forces the ratchet out of the way against the force of a restoring spring and this enables the release cam to return to a position in which it may act on the release cam follower very much more rapidly than if it were to continue to rotate in the same direction.

Further features and details of the invention will be apparent from the following description of one specific embodiment of door closing and latching mechanism, which is given by way of example only with reference to the accompanying drawings, in which.

Figure 1:
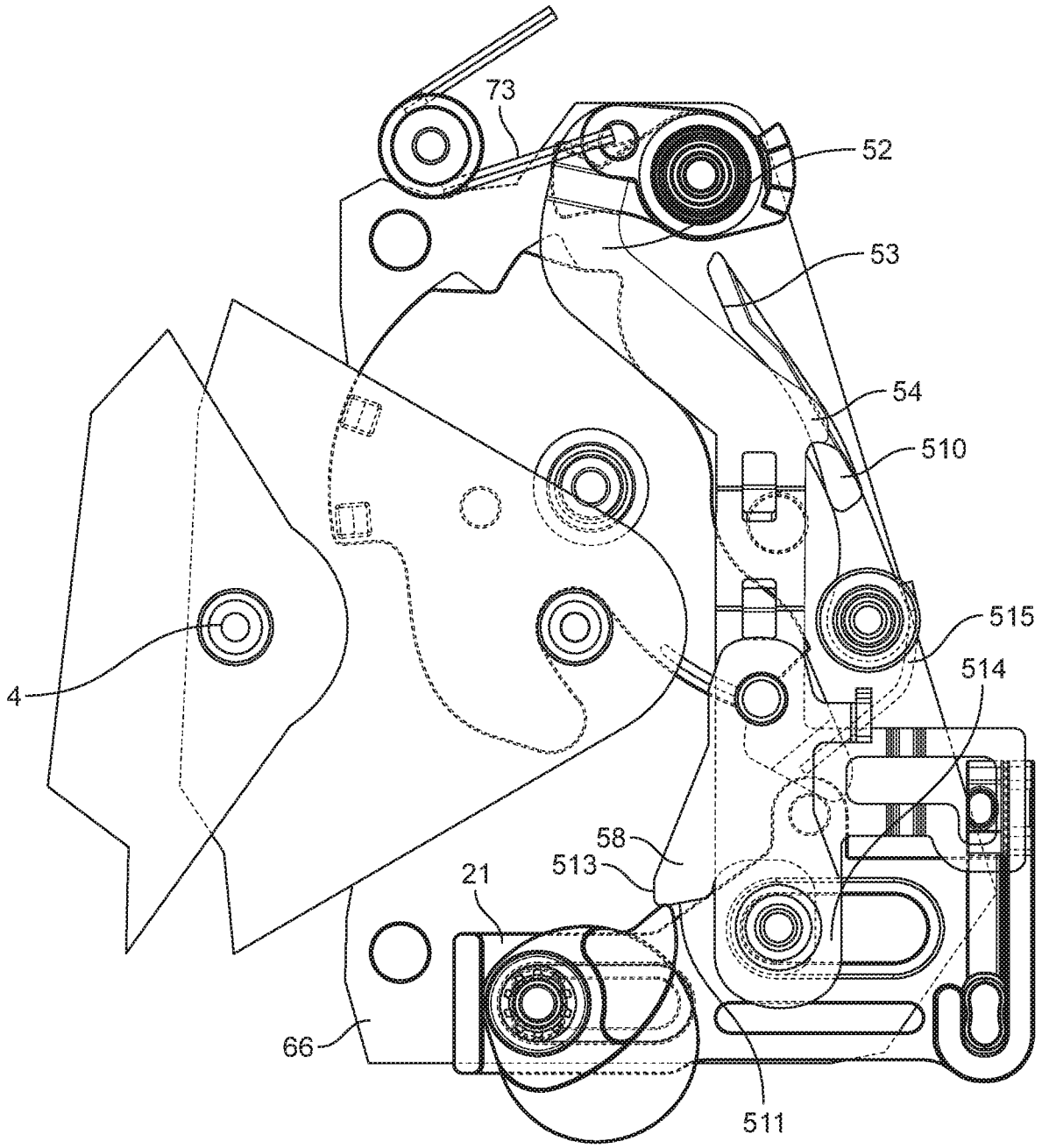
FIG. 1 is a plan view of the mechanism, from which certain components have been omitted for the sake of clarity with the claw shown in the fully latched position and the striker shown in both the fully latched position and in a position before it is latched.
Figure 2:
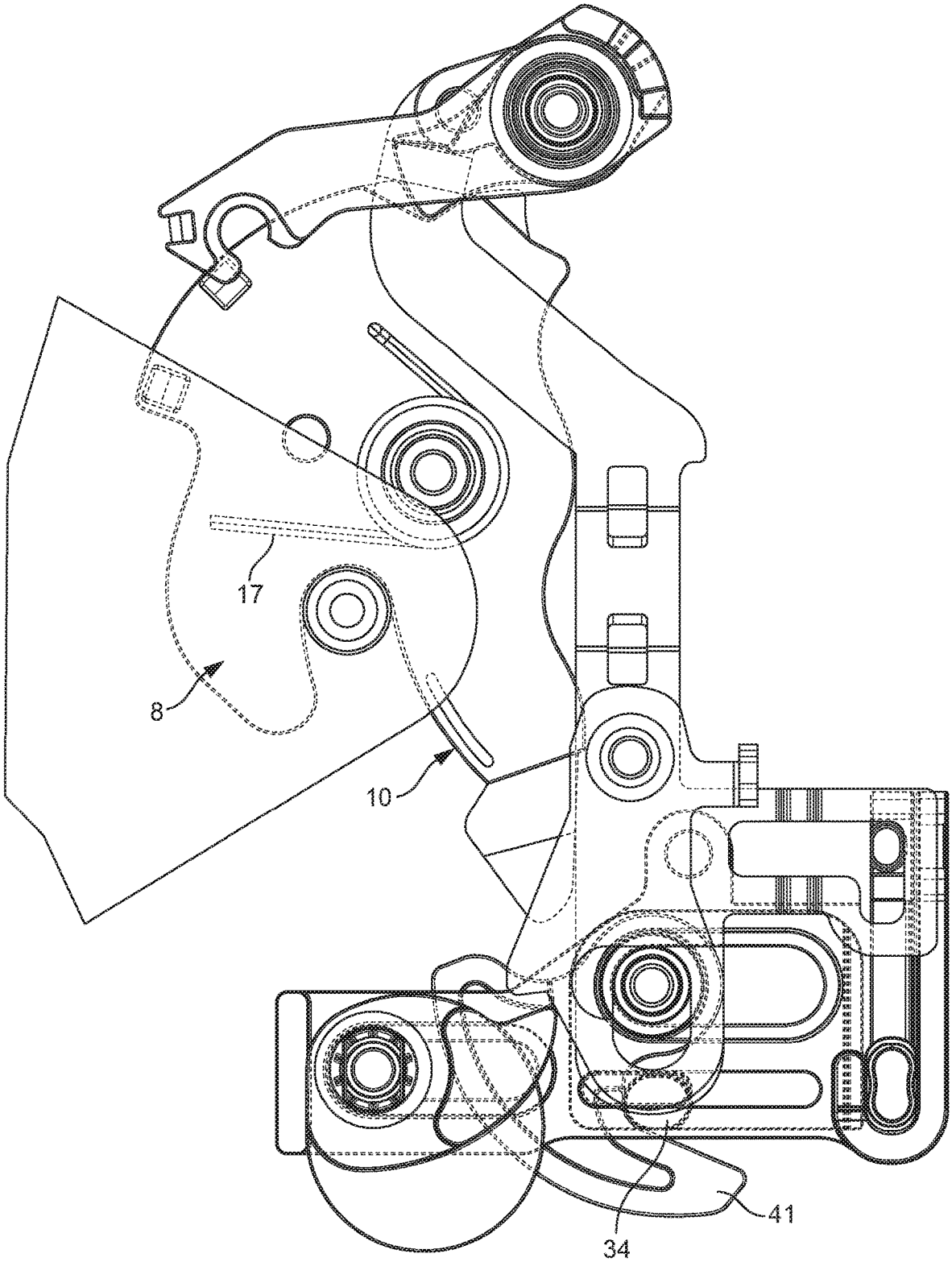
FIG. 2 is a further plan view from which further components have been omitted, showing the claw in the intermediate latched position.
Figure 3:
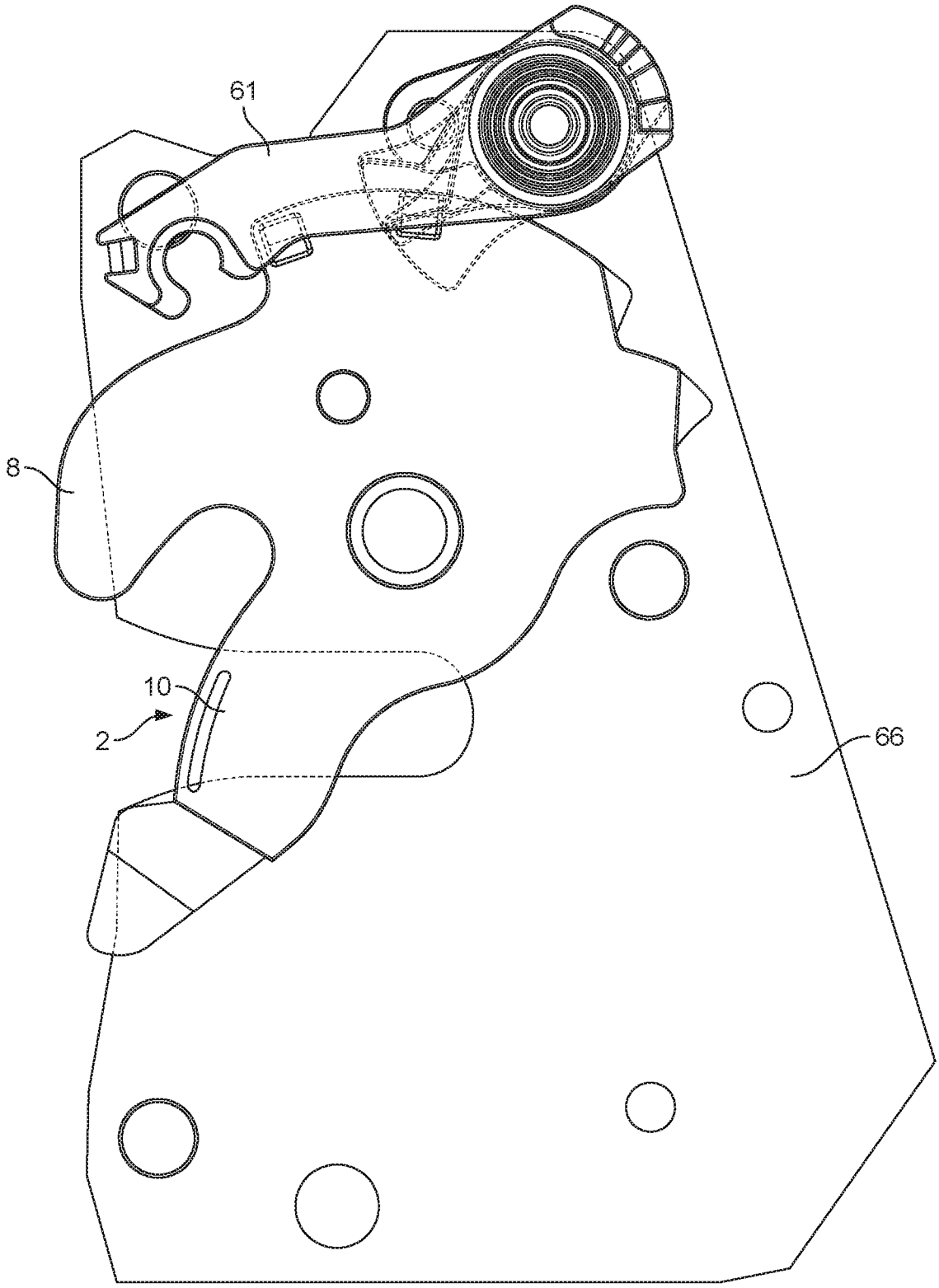
FIG. 3 is yet a further plan view from which certain components have been omitted, showing the claw in the unlatched position.
Figure 4:
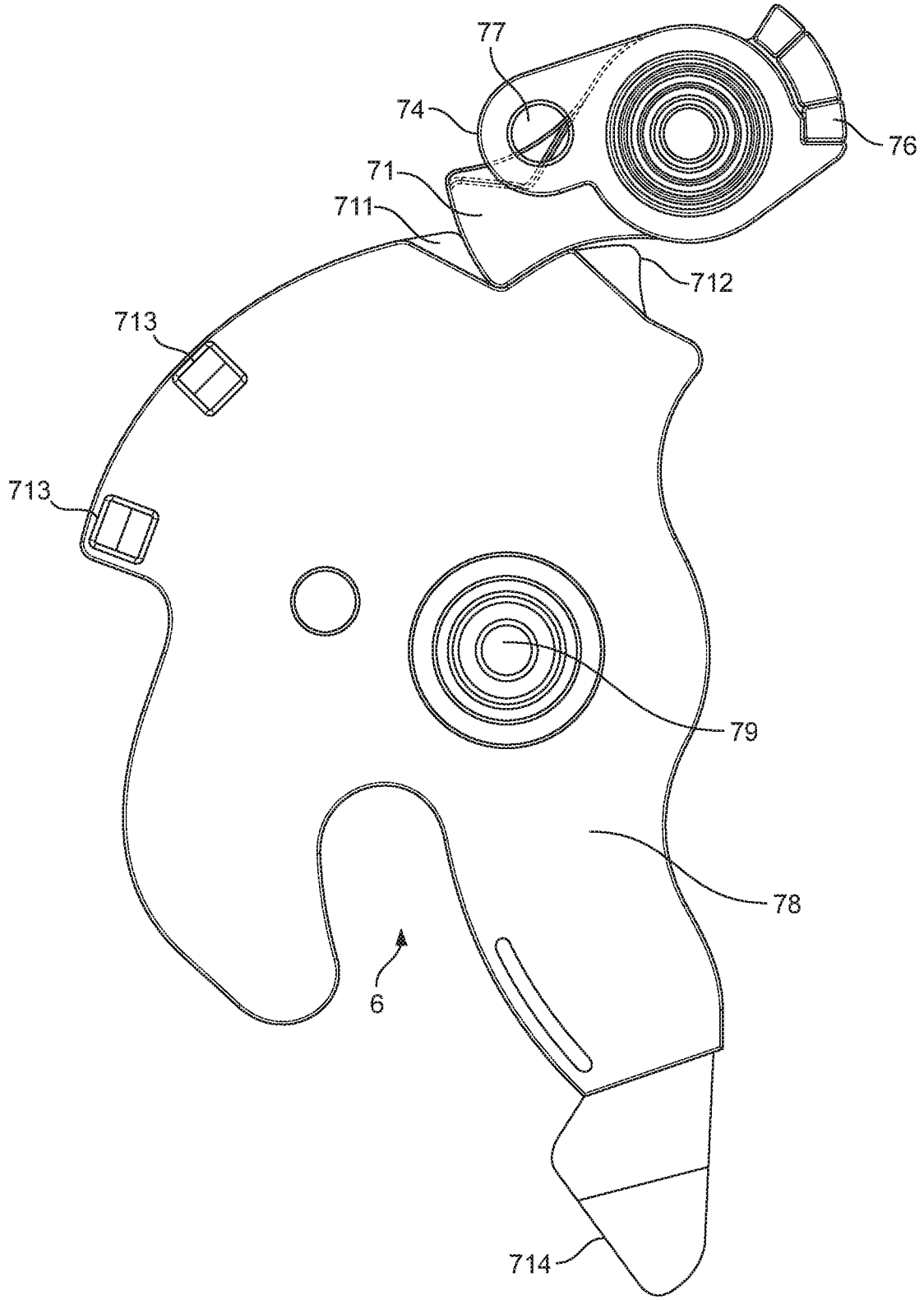
FIG. 4 is a scrap plan view showing the claw, pawl and release drive dog.

The closure and latching mechanism is accommodated in an outer housing and for the sake of clarity only the base plate or retention plate 66 of the housing is shown in FIGS. 1 and 3. The housing defines an elongate opening 2, into which the striker 4 of a door, which is not shown, may enter. Connected to the retention plate 66 to rotate about a shaft 79 is a latching claw 78, which includes two arms, a short arm 8 and a long arm 10, which define between them an elongate recess 6. The claw is rotatable about the shaft 79 between three positions. The first of these is the unlatched position, shown in FIG. 3, in which the claw is offset about 45° in the clockwise direction from the latched position shown in FIG. 1. In this unlatched position, the opening 2 in the housing is accessible and the door striker may freely enter and leave the opening 2. The second position, shown in FIG. 2, is a partially latched position, in which the claw is offset about 25° in the clockwise direction from the position shown in FIG. 1. When the door is closed manually, the striker will impinge against the long arm 10 and cause the claw to rotate in the anticlockwise direction, as seen in FIG. 1. In this position exit of the striker from the opening 3 is blocked by the arm 8. The third position is the fully latched position shown in FIG. 1, in which the striker is forced into the opening 2 and held there and the associated door is fully closed. The claw is biased into the unlatched position by a claw spring 17. At the free end of the arm 10 is a latching cam follower surface or clinch cam follower 714 and remote from the arms 8 and 10 the claw affords a primary retaining notch 712, affording a primary retaining surface and a secondary retaining notch 711 affording a secondary retaining surface. The function of these surfaces will be described below. The claw also carries one or more position sensor magnets 713, whose function will also be described below.

Figure 5:
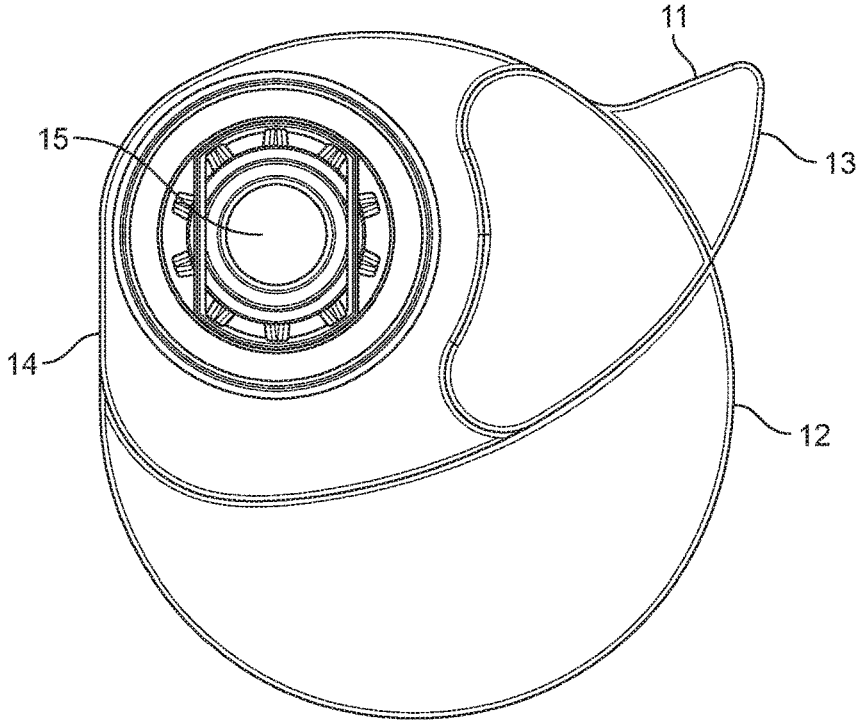
FIG. 5 is a plan view of the first, second and third cams.
Figure 6:
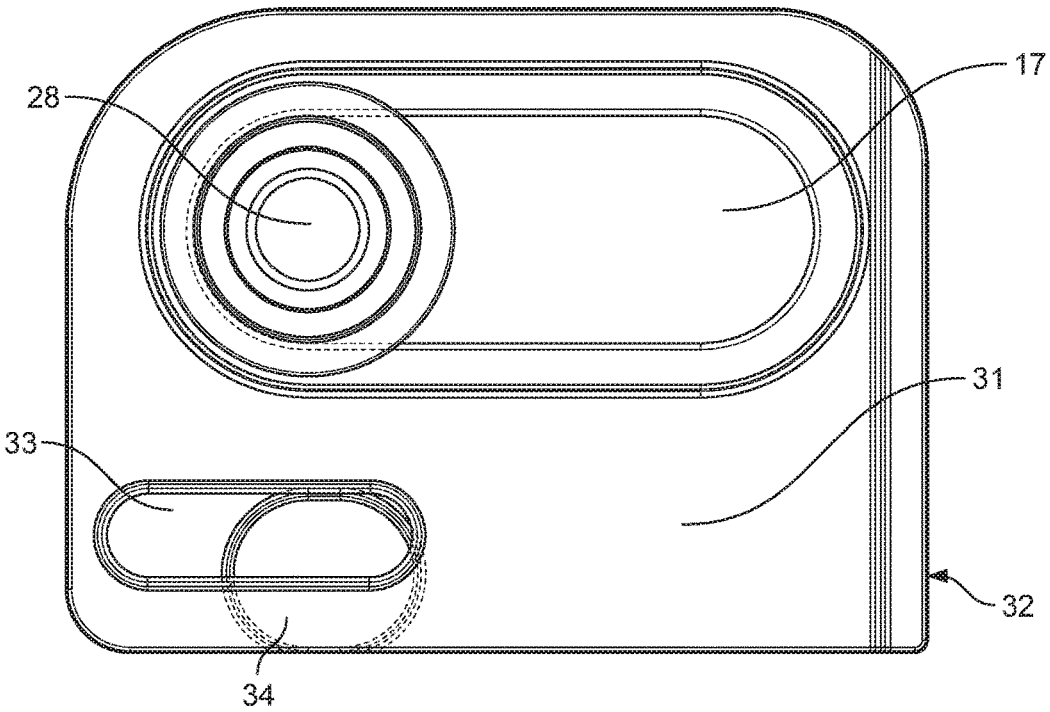
FIG. 6 is a plan view of the clinch drive dog.

Pivotally connected to the retention plate 66 by way of a pivotal support 29 is a further pivotal shaft 29, which constitutes the power input shaft and is connected, in use, to an electric drive motor. Connected to rotate with the shaft 29 is a composite actuator cam, shown in FIG. 5, which includes a first cam in the form of a projecting nose 11, a second cam or first power clinch cam 12, a third cam 13, constituted by one side of the nose 11 and a substantially straight rest surface 14 afforded by the cam 12.

Figure 7:
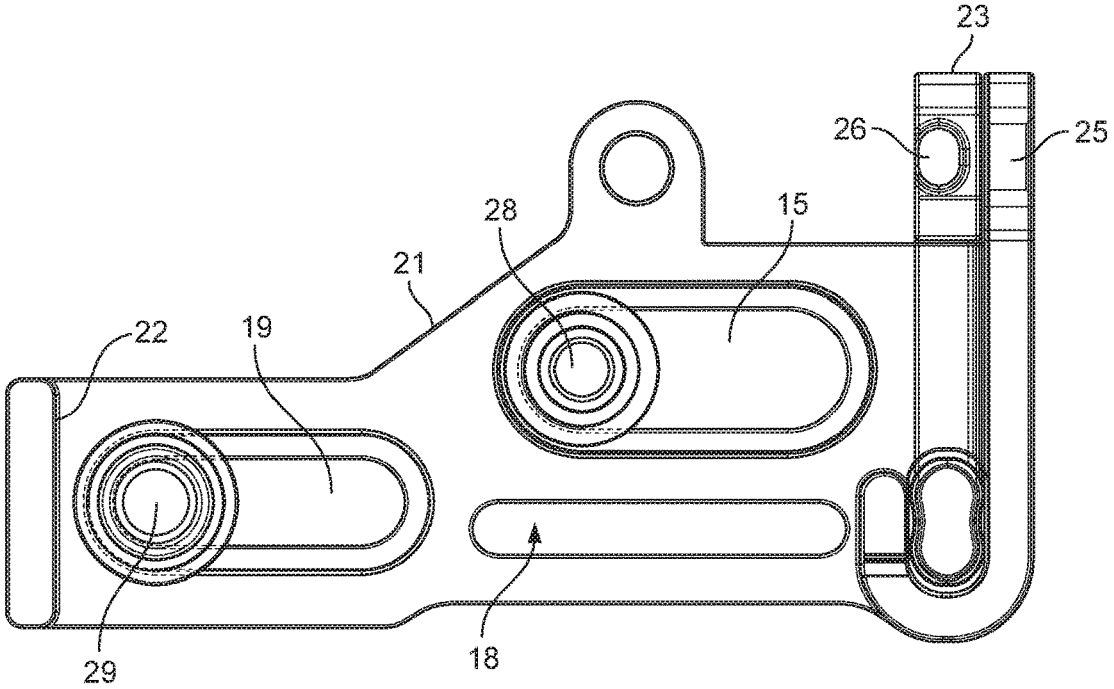
FIG. 7 is a plan view of the clinch slider and manual clutch.
Figure 10:
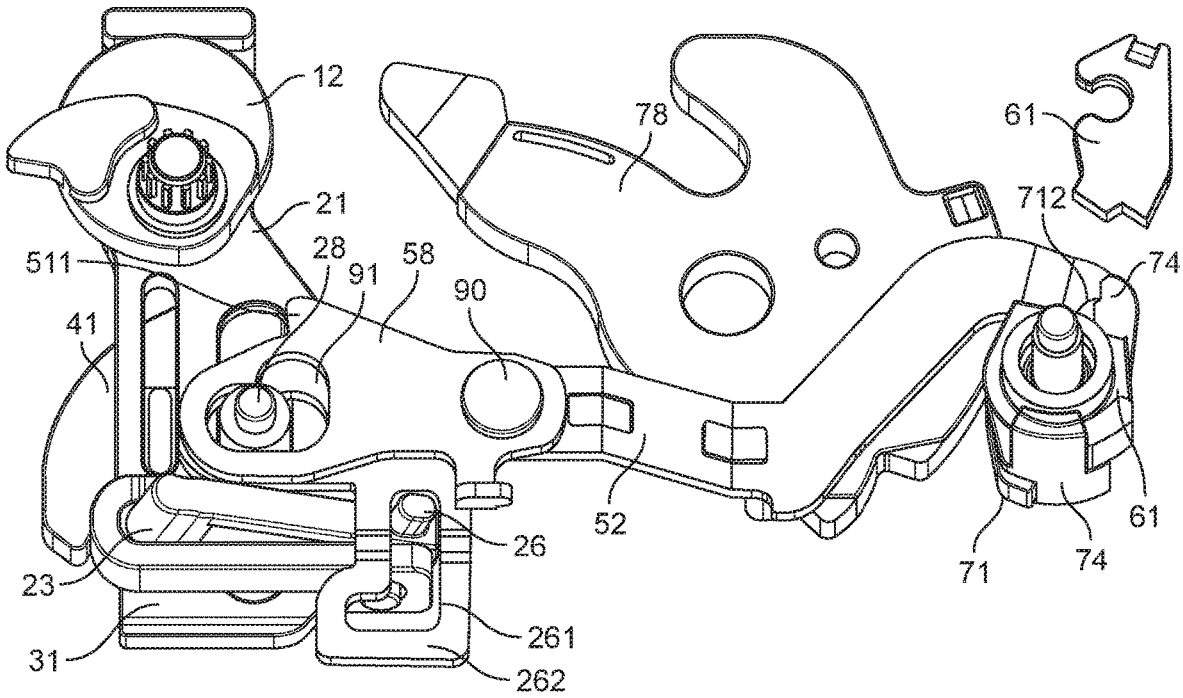
FIG. 10 is a further perspective view of the latch from which certain components have been omitted for the sake of clarity.

Situated beneath the composite actuator cam is an elongate clinch slider 21, which is guided to move only parallel to its length by virtue of the fact that the shaft 29 passes through a first elongate slot 19 in the clinch slider and that a further shaft 28 passes through a second slot 15 (see FIG. 7) 5 in the clinch slider offset from the first slot 19. At its left-hand end, as seen in FIG. 7, the clinch slider carries an upstanding ledge whose side surface 22 constitutes a third cam follower, which is in contact with the rest surface 14 or the power clinch cam 12, depending on the rotary position of the composite actuator cam. At its end remote from the third cam 32 is a clutch bar 23, which is mounted at one end to rotate with respect to the clinch slider 21 by a pivotal shaft 25, which extends parallel to the slots 19 and 15 (FIG. 7) 5. Upstanding from the clutch bar is a boss 26, which will be described in more detail below. The clutch bar normally extends below the clinch slider and constitutes an abutment 23 (FIG. 10).

Situated below the clinch slider is a clinch drive dog 31, which is constrained to be movable only linearly parallel to the direction of movement of the clinch slider 21 by the shaft 28 extending through a linear slot 17 and by a linear upstanding guide formation 33 on its upper surface extending into or through a further linear slot 18 formed in the clinch slider. Extending downwardly from the clinch drive dog 31 is a generally cylindrical projection 34, which constitutes a fourth cam.

Figure 8:
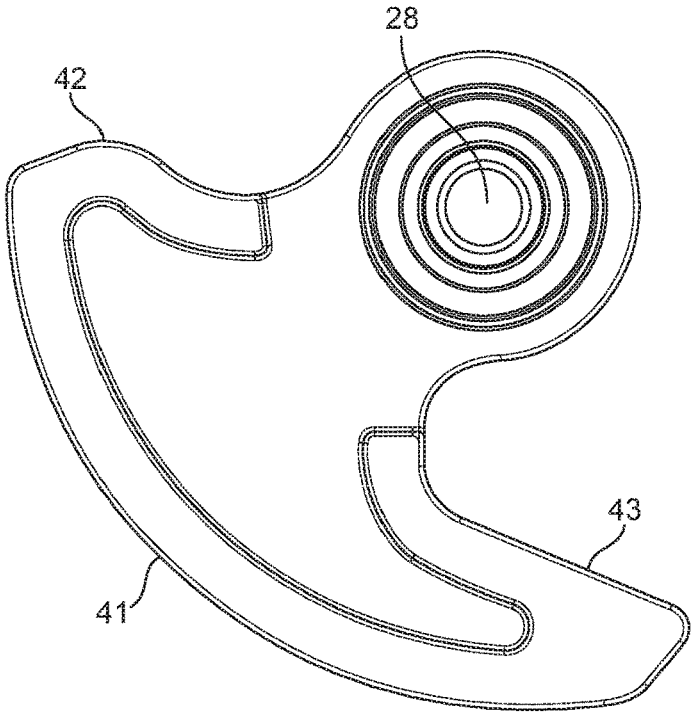
FIG. 8 is a plan view of the clinch lever.

Situated below the clinch drive dog 31 and mounted to pivot about the shaft 28 is a clinch lever 41, shown in FIG. 8. The clinch lever is of generally asymmetrical T shape and the side surface 43 of one limb of the T constitutes a fourth cam follower surface, which is in engagement with the fourth cam 34. A portion of the surface of the other limb of the T constitutes a fifth cam 42, which is positioned to contact the clinch cam follower 714 constituted by a portion of the surface of the claw, referred to above. Accordingly, when the clinch slider moves to the left, as seen in FIGS. 1 and 2, the engagement of the clutch bar 23 with the clinch drive dog 31 causes the clinch drive dog also to move linearly to the left. This results in the fourth cam 34 engaging the fourth cam follow surface 43 and thus in rotation in the clockwise direction of the clinch lever. This rotation results in the fifth cam 42 engaging the cam follower surface 714 and thus in the claw rotating in the anticlockwise direction in FIGS. 1 and 2, that is to say from the semi-latched position to the fully latched position.

Figure 9:
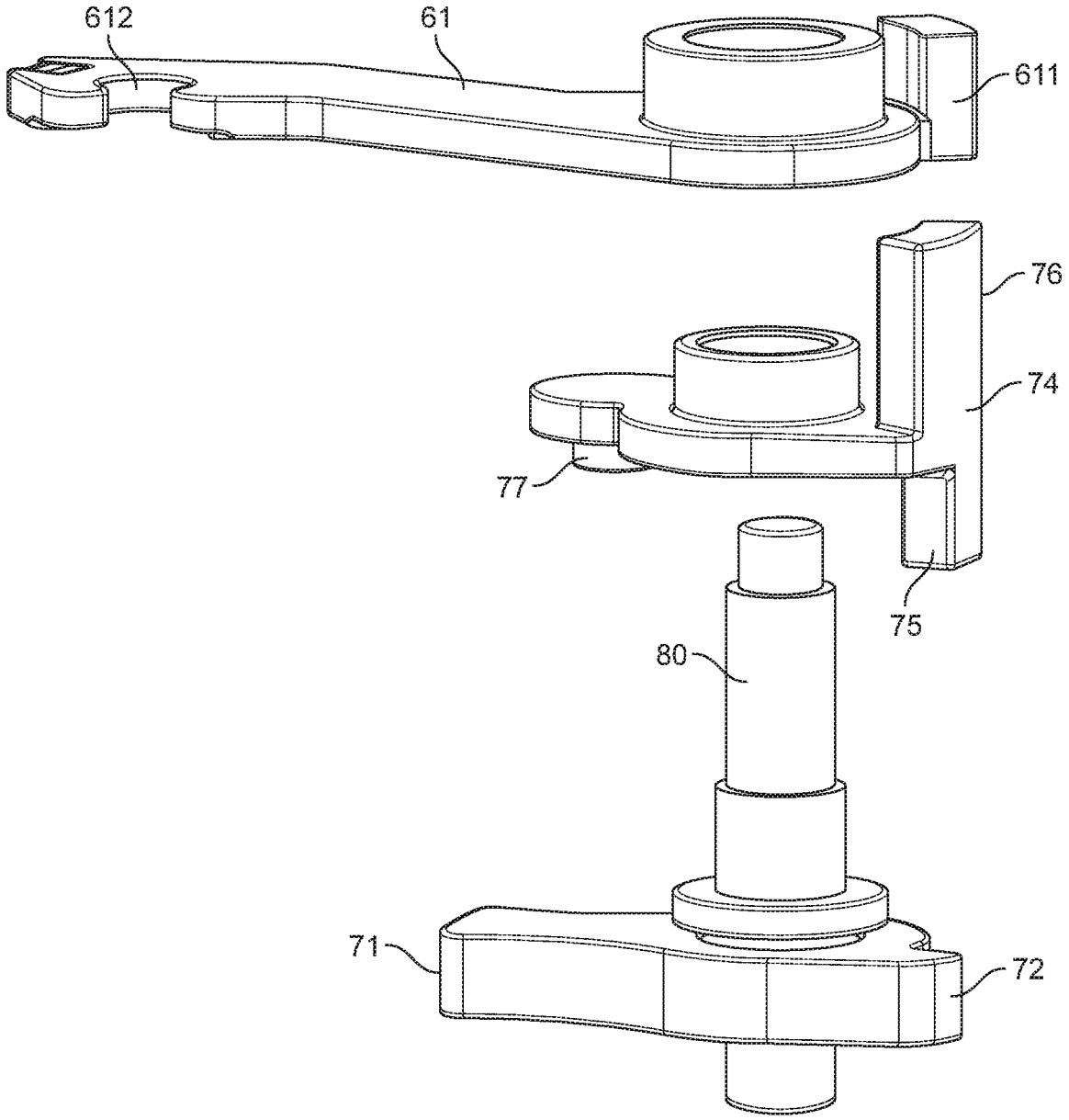
FIG. 9 is an exploded perspective view of the pawl and the components associated with it.

As best seen in FIG. 9, upstanding from the other end of the retention plate 66 is a further fixed pivotal shaft 80. Rotatably carried by the shaft 80 is a latching pawl 71, which affords an abutment surface 72. Also pivotally carried by the shaft 80 above the latching pawl 71 is a release drive dog 74 with a downwardly extending lower tab 75 affording a first abutment surface, which is arranged to contact the surface 72 on the pawl 71, and an upwardly extending upper tab 76 affording a second abutment surface. Extending downwardly from the release drive dog 74, and shown in FIG. 9 only in chain lines, is a pivotal boss 77. Also pivotally carried by the shaft 80 above the release drive dog is a manual release lever 61 carrying a tab 611, which affords a third engagement surface arranged to contact the second engagement surface on the tab 76 of the release drive dog 74. The release lever 61 is in the form of an elongate arm and near its outer end affords a notch or recess 612 in which a manual release cable or the like (not shown) may be secured. The pawl 71 is biased by a spring 73 into contact with the side surface of the latching claw 78. If the claw 78 is moved into the semi-latched position, the pawl will be urged by the spring 73 into the secondary retaining notch 711 and will engage a surface of that notch and prevent the claw from returning to the unlatched position under the action of its return spring 17. If the claw is moved into the latched position, the pawl will be urged into the primary retaining notch 712 and will engage a surface of that notch and prevent the claw from returning to the semi-latched position or the unlatched position under the action of its return spring.

In use, the input shaft 15 is generally rotated only in one direction, that is to say anti-clockwise, as seen in the drawings, to both latch and unlatch a door and its movement is transmitted through two different pathways to the claw to move it from the semi-latched to the latched position and to the pawl to move it out of engagement with the primary retaining notch 712. When the latch is in the fully latched position, rotation of the input shaft 15 is transmitted via the first cam 11 to an elongate release slider 52 which is mounted to be movable substantially only linearly parallel to its length. One end of the release slider 52 has a hole formed in it, through which the pivotal boss 77 on the release drive dog 74 passes, such that linear movement of the release slider results in rotation of the release drive dog about the shaft 80. Pivotally connected to the release slider at a position adjacent its other end by means of a pivot pin 90 is one end of an elongate release ratchet 58. Formed in the release ratchet opposite its other end is an L-shaped slot 91, through which the shaft 28 extends. When the latch is latched, the release slider is generally in the position shown in FIG. 2 in which the shaft 28 is received in a first limb of the L-shaped slot which extends transversely to the length of the release slider and rotation of the ratchet 58 relative to the release slider is permitted. However, when the release slider is moved in order to rotate the pawl into the released position, as seen in FIG. 10, the shaft 28 is received in the second limb of the L-shaped slot extending parallel to the length of the release slider and ratchet and limited pivotal movement of the ratchet relative to the release slider is therefore not possible.

Alternatively, the ratchet is provided with one extended arm 514 (FIG. 1) which abuts against shaft 28 and held resiliently in that position by a spring 515 and provided with a shoulder on the opposing side formed as a cam follower 511 to cooperate with the release cam 11. When rotated counter clockwise, cam 11 attacks the ratchet at the shoulder 513 (FIG. 1). The force applied by the release cam 11 has two coordinates; a linear force acting on the slider to move it to rotate the pawl to release the claw and a rotary force acting on the ratchet to maintain it held against the shaft 28 while moving to rotate the pawl to release the claw. Though prevented by shaft 28, the second force coordinate has the effect of rotating the ratchet clockwise. In this embodiment the ratchet is permitted within the scope allowed to rotate counter clockwise and is always prevented from rotating clockwise by shaft 28 regardless of the position of the slider. Cam 13 rotates the ratchet counter clockwise to a limited extent. This extent is represented by the angular degree defined between the rest position of the ratchet and the point whereby cam 13 rotates past the ratchet. Once disengaged from cam 13, the ratchet is returned to its rest position by spring 515.

Projecting laterally from the release slider 52 is a plate 262 in which an L-shaped slot 261 is formed. This slot has a relatively long limb extending transverse to the length and direction of movement of the release slider and a relatively short limb extending parallel to the length of the release slider. The pivot boss 26 of the clutch arm 23 projects through this slot and is normally received in the relatively short limb of the slot 261, whereby movement of the release slider parallel to its length and relative to the pivot boss 26, is possible only during the release operation, whereby the slider is moved to rotate the pawl to release the claw and not possible during the clinch operation whereby the claw is driven from the secondary latch position to the primary latch position without breaking the dynamic link and interrupting the clinch operation to release the claw.

If it is desired to move the latch from the fully latched to the unlatched position, the input shaft 15 is rotated anti-clockwise, as seen in FIG. 1, and thus brings the cam 11 into contact with the shoulder 511 on the ratchet 58. The ratchet and release slider act as a single body and the force exerted on the ratchet by the cam 11 moves the release slider to rotate the pawl to release the claw, as seen in FIG. 10. This movement is transmitted to the release drive dog 74, which is caused to pivot about the shaft 80. This brings the engagement surface on the lower tab 75 into engagement with the engagement surface 72 on the pawl 71 and causes the pawl to rotate clockwise, as seen in FIG. 9, and thus to move out of engagement with the primary retaining notch 712 or the secondary retaining notch 711. The claw is then moved rapidly under the action of its retaining spring to the unlatched position and the door striker 4 is released, thereby enabling the associated door to be opened.

Once the release slider has been moved to unlatch the pawl and the cam 11 has moved past the shoulder on the ratchet, the drive motor is deactivated and the cam 11 stops rotating.

If the door is now moved in a closing direction, the door striker 4 will engage the arm 10 of the claw and rotate the claw into the semi-latched, "secondary" position. Detecting the claw in this position is enabled by sensors, not shown, responsive to magnets 713 on the claw, which induce the electronic control system comprising the magnet-responsive sensors which are integrated in the latch, not shown, to drive the electric motor and rotate the input shaft 15 further in the counter clockwise direction. This actuation causes the second cam 12 on the input shaft to act on the second cam follower 22 on the clinch slider 21 and thus to move the clinch slider to the left, as seen in FIG. 1. As it does so the clutch bar 23 (FIG. 10) on the clinch slider engages the clinch drive dog 31, which is thus conjointly moved linearly to the left. As it does so, the fourth cam, i.e. the cylindrical projection 34 engages the fourth cam follower 43 on the clinch lever 43. This causes the clinch lever to rotate clockwise, which in turn causes the fifth cam 42 on the clinch lever to engage the fifth cam follower 714 on the claw 78 and thus rotate the claw 78 in the anticlockwise direction, as seen in FIG. 1, into the full or primary latch position. As mentioned above, the clinch lever is of asymmetrical T shape and the arm affording the fourth cam follower 43 is significantly longer than the arm constituting the fifth cam 42. At the start of the clinch operation the projection 34 is in contact with the cam follower 43 at a point substantially closer to the pivot of the clinch lever 41, thus transmitting substantially lesser power generally below 50% of the total available and increasing closer to full power as the clinch operation progresses closer to the end of the clinch operation. This arrangement provides an important safety advantage whereby a trapped object between the striker and the latch (the door and its frame/body of the car) at the start of the clinch operation will receive substantially lesser force and therefore the mechanism is substantially likely to stall before the power reaches a higher more damaging level, thus preventing damage to the trapped object. The progressive increase in the level of power transmitted by the clinch lever is explained by the incremental increase in the mechanical advantage created by the progressive outward displacement of cam 34 against the fourth cam follower 43 relative to the centre of rotation of the clinch lever. At the start of the clinch actuation the rate of transmission is generally 0.5 to 1 whereas at the end it is substantially 1 to 1. Thus, the power being transmitted at the end is substantially more than double that which is available at the start of the clinch actuation. Therefore a trapped object would receive a pressure force of the magnitude of 10 kg to 15 kg before the mechanism stalls as opposed to 30 kg to 50 kg towards the end of the actuation. This particular arrangement on one hand serves as a safety measure and on the other satisfies the need to provide more closing force to react to the closing force acting on the door striker, which progressively increases as the door moves into the fully latched position. This is precisely what is needed to counter the increase of the reaction force created by the door weather seal as it compresses progressively towards the end of the door closing process. This feature therefore permits the electric motor to be significantly smaller and cheaper than would otherwise be the case. This effect is further enhanced by the fact that the fifth cam follower 714 is situated 2 to 4 times, in this case 3 times, as far from the pivotal axis of the claw as the door striker 4 with respect to its contact point with the claw arm 8, thereby resulting in a yet further mechanical advantage during the latching process. A further substantial mechanical advantage is provided by the shape of the second cam 12 relative to its axis of rotation, its position in relation to the clinch slider 21 and the cam follower 22. This arrangement enables the conversion of the torque imparted by cam 12 into linear force acting on the clinch slider at a rate of 3 to 5 times, in this case substantially 4 times. In other words if the clinch slider were to be driven by a direct linear force a motor 4 times the power would have been required to achieve that compared with the current arrangement in which a smaller motor was used with the advantage of cam 12. The combined effect of these features is to provide an overall mechanical advantage of between 10 and 20, typically 15.

The door latch in accordance with the present invention is of course primarily electrically operated and will therefore be associated with an electronic control system, though this is not illustrated. Thus it is envisaged that when it is desired to open the door, this is indicated by operating an electrical switch, e.g. of push button type. However, it is desirable that manual operation is also possible, e.g. in the event of electrical failure, and in the preferred embodiment a cable or the like is operatively connected to the manual release lever 61, as described above. If the cable is pulled by the user, this will result in the lever 61 moving in the clockwise direction, as seen in FIG. 9. This will bring the third engagement surface on the tab 611 of the release lever into contact with the second engagement surface on the tab 76 of the release drive dog 74 and rotate the release drive dog in the clockwise direction also and the engagement of the engagement surfaces on the drive dog and the pawl will rotate the pawl in the clockwise direction and cause the pawl to disengage from the claw, whereby the claw will then return rapidly to the unlatched position.

As mentioned above, during normal release movement of the release slider the boss 26 of the clutch arm 23 (FIG. 10) is received in a portion of the L-shaped slot 261 and has no effect on this movement. However, if the clinching process is interrupted before it is completed, e.g. by an electrical failure or an interruption of the electrical power supply, operating the manual release lever will cause the dynamic link holding together as one unit the cluster comprised of the clutch arm 23, which is pivotally carried by the clinch slider 21, the clinch drive dog 31, the cam 34 of the clinch drive dog, the cam follower 43 of the clinch lever 41, the cam 42 and the cam follower 714 of the claw 78, which is coupled to the striker 4 by means of arm 8, to break from an operatively integrated unit during the clinch operation into individual components whereby the claw is free to rotate clockwise to release the striker. By pulling on the manual release lever 61, the release drive dog 74 is forced to rotate clockwise pulling with it by means of the engagement boss 77, in a combined linear and rotary motion the release slider 52. The release slider being operatively engaged with the clutch arm 23 by means of the projection 26, which is operatively constrained by the slot 261, thus rotates the clutch arm 23 clockwise from a position whereby it holds the entire clinch cluster together as one operative unit into a position whereby the cluster is broken up into individual components. Simultaneously, as the manual release lever is rotated clockwise to break the clinch dynamic link, the pawl is also rotated to release the claw which is now free to rotate clockwise as the clinch lever becomes free to rotate to its pre-clinch rest position by a dedicated return spring not shown.

Figure 11:
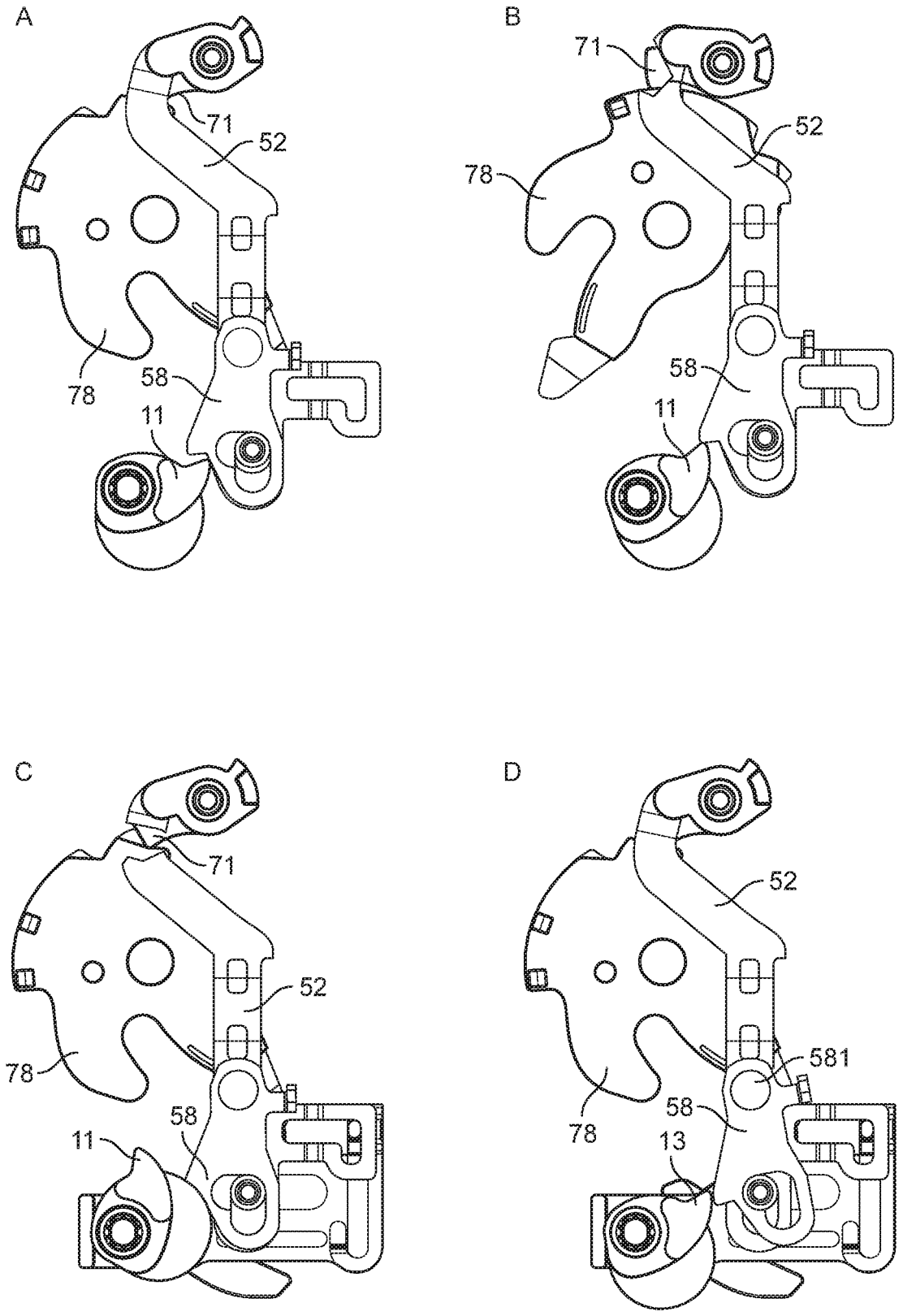
FIGS. 11A, B, C and D show the different stages when unlatching the latch by reverse rotation of the input shaft.

The various stages of movement of the release ratchet 58 and the claw 78 are shown in FIGS. 11A to 11D. FIG. 11A shows the first cam 11 at rest, that is to say in the pre-release position, and the claw 78 in its fully latched position. The release ratchet 58 is in its rest position aligned to cooperate with the first cam 11 to release the claw 78 when the cam 11 is rotated anticlockwise. FIG. 11B shows the first cam 11 in an intermediate position having already caused the release of the claw 78 when rotated anticlockwise through about 30°. The claw 78 is shown in its released position and the release slider 52 is shown moved by a short distance, e.g. 3 mm, to enable the release of the claw 78 from its fully latched position. The claw 78 is shown in the position in which it is ready to receive the striker. FIG. 11C shows the first cam 11 and the third cam 13 in a position past the release or pre-clinch position and ready to rotate clockwise to come into contact with the release ratchet 58 to rotate it anticlockwise to a position where it is able to engage the release ratchet 58 and the release slider 52 to enable release of the claw 78. FIG. 11D shows the third cam 13 in the course of rotating clockwise, thus causing the release ratchet 58 to rotate anticlockwise to a position such that the first cam 11 is able to move to a position in which it is able to engage the release ratchet 58 to release the claw back to the position shown in FIG. 11A.

This feature is particularly valuable if the cam 12 should fail to rotate fully to complete the clinch operation or for instance to interrupt the power clinch operation.

By rotating the input 15 in a direction opposite to the normal direction, i.e. clockwisecam 13 is brought into contact with the release ratchet 58, which is then pivoted about its pivot shaft 90 (FIG. 10) against the force of its restoring spring until the release ratchet is able to pivot back to its original position under the force of its return spring. As soon as the cam 11 has moved back past the shoulder 511 on the ratchet 58, the direction of the motor is reversed and the cam 11 will then act on the shoulder 511 and move the release slider 52 so as to release the latch. Moving the cams 12 and 13 backwards is considerably faster than continuing to rotate them in the usual anti-clockwise direction because a smaller angular rotation is required and this enables the latching mechanism to react more rapidly to a command to unlatch the latch countermanding a previous instruction to latch it.

The latching mechanism in accordance with the invention has numerous advantages over known latching mechanisms. In particular, it has a substantially reduced weight and size and thus reduced cost and also reduced power consumption. It enables clinching or latching under a load in excess of 1000N with an electric current of only 1.5 to 1.8 amps using a 12 volt DC motor weighing around 60 grams as compared to a weight of between 200 and 400 grams of the motor used in similar systems. This is achieved by the specific mechanical arrangement of the cam 12 and the cam follower integrated with the clinch slider, which results in a considerable mechanical advantage. As described above, overall a mechanical advantage of up to 15 or even more may be obtained, thereby permitting the use of a considerably smaller, lighter and cheaper electric motor. The latching mechanism provides an anti-trapping function with or without electronic control. This is an important advantage and enables protection against damage to articles or fingers if they should become trapped in the door during the clinching or latching operation, even without electronic control or when such electronic control fails to perform. The movement is achieved by a number of integrated cams and cam followers, thereby resulting in operation with substantially zero backlash, and this in turn means that operation is silent. Backlash is an inherent feature of gear mechanisms which need to have a certain clearance between the teeth of the meshing gearwheels. This clearance necessarily results in impact noise as each gear tooth comes into contact with a corresponding tooth. By contrast, a system operated exclusively with cams is noiseless due to the nature of the contact between the cooperating components. Movement is smooth and continuous with no impact and a substantial mechanical advantage may be obtained in a relatively small space. A further significant advantage of the latching mechanism in accordance with the invention is its exceptionally low power consumption as it enables the use of miniature motors with stall currents below 2 amps as compared to the 12 to 36 amp motors that are normally required for similar devices.

The invention claimed is:

1. A closing and latching mechanism for a closure, said closing and latching mechanism comprising:

a claw for engaging a striker fixed to the closure, the claw being rotatable between an unlatched position and a latched position and biased by a spring towards the unlatched position, a pawl mounted to pivot between a first position, in which it can engage the claw in the latched position and prevent movement of the claw into the unlatched position, and a second position, in which the claw is free to move from the latched position to the unlatched position, a rotatable input shaft carrying a first clinch cam which is operatively coupled to the claw, whereby rotation of the input shaft in one direction results in rotation of the claw into the latched position, the input shaft also carrying a release cam which cooperates with a release cam follower coupled to a release slider, the release slider being operatively coupled to the pawl, whereby further rotation of the input shaft in said one direction results in engagement of the release cam with the release cam follower and movement of the release slider which moves the pawl into the second position and the claw then moves towards the unlatched position under the action of the biasing spring, and wherein the first clinch cam is operatively coupled to the claw by a first clinch cam follower, which cooperates with the first clinch cam and is provided on a linearly movable clinch slider, the clinch slider being operatively coupled to a second clinch cam, which cooperates with a second clinch cam follower forming part of a pivotally mounted clinch lever, a further part of the clinch lever constituting a third clinch cam which cooperates with a third clinch cam follower constituted by a portion of the claw.

2. The mechanism as claimed in claim 1 in which the operative coupling between the first clinch cam and the claw provides a mechanical advantage of at least 2.

3. The mechanism as claimed in claim 2 in which the operative coupling is constructed so that the mechanical advantage increases as the claw approaches the latched position.

4. The mechanism as claimed in claim 2 in which the clinch lever is of generally T shape with the head of the T shape constituted by two limbs, a first of which constitutes the second clinch cam follower and the second of which is shorter than the first limb and constitutes the third clinch cam.

5. The mechanism as claimed in claim 4 in which the distance of the third clinch cam follower from the axis of rotation of the claw is at least two times greater than the distance between said axis of rotation and a position at which, in use, the claw engages the striker.

6. The mechanism as claimed in claim 1 including a manual release lever which is operably coupled to the pawl and the operation of which results in movement of the pawl into the second position.

7. The mechanism as claimed in claim 6 in which operating the manual release lever to release the claw also drives the release slider to a position whereby the release slider and pawl are held in a claw releasing position until the claw is rotated to its fully open position and whereby releasing the claw at a certain point past a half latch position frees the pawl back to its ready to re-engage the claw position.

8. The mechanism as claimed in claim 1 in which the operative coupling between the first clinch cam and the claw includes a clutch which is selectively operable to sever the operative coupling.

9. The mechanism as claimed in claim 8 in which the clutch comprises a clutch member connected to the clinch slider and movable between an engaged position in which movement of the clinch slider in the latching direction is transmitted to the claw and a disengaged position in which movement of the clinch slider is not transmitted to the claw.

10. The mechanism as claimed in claim 1 including a release drive dog mounted to pivot about the same axis as the pawl and arranged to engage the pawl and to rotate it from the first position into the second position, the release drive dog being pivotally connected to the release slider and arranged to pivot about the said axis when the release slider is caused to move by the release cam.

11. The mechanism as claimed in claim 10 in which a manual release lever is mounted to pivot about the same axis as the pawl and is arranged to engage the pawl and to rotate it from the first position into the second position when the manual release lever is operated.

12. The mechanism as claimed in claim 1 in which the release slider carries a ratchet which affords the release cam follower, the ratchet being movable between a third position, in which the release cam can engage the release cam follower and move the release slider in the un-latching direction, and a fourth position in which the release cam may move past the release cam follower without contacting it, movement between the third position and the fourth position being permitted when the release cam is not in contact with the release cam follower and being prevented when the release cam is in contact with the release cam follower, the mechanism carrying a third cam arranged to engage the ratchet and push it from the third position to the fourth position.

13. The mechanism as claimed in claim 1 in which the operative coupling between the first clinch cam and the claw provides a mechanical advantage of at least 2.

14. The mechanism as claimed in claim 1 in which the operative coupling between the first clinch cam and the claw provides a mechanical advantage of at least 4.

15. The mechanism as claimed in claim 1 in which the operative coupling between the first clinch cam and the claw provides a mechanical advantage of at least 4.

16. The mechanism as claimed in claim 1 in which the clinch lever is of generally T shape with the head of the T shape constituted by two limbs, a first of which constitutes the second clinch cam follower and the second of which is shorter than the first limb and constitutes the third clinch cam.

17. The mechanism as claimed in claim 1 in which the distance of the third clinch cam follower from the axis of rotation of the claw is at least two times greater than the distance between the said axis of rotation and the position at which, in use, the claw engages the striker.

18. The mechanism as claimed in claim 1 in which the operative coupling between the first clinch cam and the claw includes a clutch which is selectively operable to sever the operative coupling.

19. The mechanism as claimed in claim 6 in which the manual release lever is mounted to pivot about the same axis as the pawl and is arranged to engage the pawl and to rotate it from the first position into the second position when the manual release lever is operated.

20. The mechanism as claimed in claim 1 in which the rotatable input shaft is configured such that the further rotation of the input shaft in the same direction occurs after the input shaft is rotated in a direction opposite to said one direction.

21. A closing and latching mechanism for a closure, said closing and latching mechanism comprising:

a claw for engaging a striker fixed to the closure, the claw being rotatable between an unlatched position and a latched position and biased by a spring towards the unlatched position, a pawl mounted to pivot between a first position, in which it can engage the claw in the latched position and prevent movement of the claw into the unlatched position, and a second position, in which the claw is free to move from the latched position to the unlatched position, a rotatable input shaft carrying a first clinch cam which is operatively coupled to the claw, whereby rotation of the input shaft in one direction results in rotation of the claw into the latched position, the input shaft also carrying a release cam which cooperates with a release cam follower coupled to a release slider, the release slider being operatively coupled to the pawl, whereby further rotation of the input shaft in said one direction results in engagement of the release cam with the release cam follower and movement of the release slider which moves the pawl into the second position and the claw then moves towards the unlatched position under the action of the biasing spring, and wherein the operative coupling between the first clinch cam and the claw includes a clutch which is selectively operable to sever the operative coupling.

22. A closing and latching mechanism for a closure, said closing and latching mechanism comprising:

a claw for engaging a striker fixed to the closure, the claw being rotatable between an unlatched position and a latched position and biased by a spring towards the unlatched position, a pawl mounted to pivot between a first position, in which it can engage the claw in the latched position and prevent movement of the claw into the unlatched position, and a second position, in which the claw is free to move from the latched position to the unlatched position, a rotatable input shaft carrying a first clinch cam which is operatively coupled to the claw, whereby rotation of the input shaft in one direction results in rotation of the claw into the latched position, the input shaft also carrying a release cam which cooperates with a release cam follower coupled to a release slider, the release slider being operatively coupled to the pawl, whereby further rotation of the input shaft in said one direction results in engagement of the release cam with the release cam follower and movement of the release slider which moves the pawl into the second position and the claw then moves towards the unlatched position under the action of the biasing spring, a manual release lever which is operably coupled to the pawl and the operation of which results in movement of the pawl into the second position, and wherein the manual release lever is mounted to pivot about the same axis as the pawl and is arranged to engage the pawl and to rotate it from the first position into the second position when the manual release lever is operated.

* * * * *